US010006269B2

(12) United States Patent
Holder

(10) Patent No.: US 10,006,269 B2
(45) Date of Patent: Jun. 26, 2018

(54) EAP ACTUATED VALVE

(71) Applicant: Superior Energy Services, LLC, Harvey, LA (US)

(72) Inventor: Barry K. Holder, Montgomery, TX (US)

(73) Assignee: Superior Energy Services, LLC, Harvey, LA (US)

( * ) Notice: Subject to any disclaimer, the term of this patent is extended or adjusted under 35 U.S.C. 154(b) by 0 days. days.

(21) Appl. No.: 15/441,817

(22) Filed: Feb. 24, 2017

(65) Prior Publication Data

US 2017/0167224 A1 Jun. 15, 2017

Related U.S. Application Data

(63) Continuation-in-part of application No. 14/328,335, filed on Jul. 10, 2014, now Pat. No. 9,611,718.

(60) Provisional application No. 61/970,775, filed on Mar. 26, 2014, provisional application No. 61/845,104, filed on Jul. 11, 2013.

(51) Int. Cl.

| | |
|---|---|
| ***E21B 34/06*** | (2006.01) |
| ***F16K 31/02*** | (2006.01) |
| ***F16K 3/26*** | (2006.01) |
| *F16K 31/06* | (2006.01) |
| *E21B 34/00* | (2006.01) |

(52) U.S. Cl.

CPC ..... *E21B 34/066* (2013.01); *F16K 3/26* (2013.01); *F16K 31/02* (2013.01); *E21B 2034/007* (2013.01); *F16K 31/025* (2013.01); *F16K 31/06* (2013.01)

(58) Field of Classification Search

CPC ..... E21B 34/066

See application file for complete search history.

(56) References Cited

U.S. PATENT DOCUMENTS

| | | | | |
|---|---|---|---|---|
| 5,309,993 | A | 5/1994 | Coon et al. | |
| 5,558,153 | A * | 9/1996 | Holcombe | E21B 23/04 166/373 |
| 5,666,050 | A | 9/1997 | Bouldin et al. | |
| 5,996,711 | A | 12/1999 | Ohmer | |
| 6,021,095 | A * | 2/2000 | Tubel | E21B 23/00 166/166 |
| 6,209,648 | B1 | 4/2001 | Ohmer et al. | |
| 6,545,384 | B1 | 4/2003 | Pelrine et al. | |
| 6,725,927 | B2 | 4/2004 | Ohmer | |
| 6,891,317 | B2 | 5/2005 | Pei et al. | |

(Continued)

FOREIGN PATENT DOCUMENTS

| | | |
|---|---|---|
| CN | 103015979 A | 4/2013 |
| CN | 103615195 A | 3/2014 |

(Continued)

*Primary Examiner* — Shane Bomar

(74) *Attorney, Agent, or Firm* — Jones Walker LLP

(57) ABSTRACT

A casing valve including a tool housing defining an internal channel from a wellbore annulus. A valve allows selective communication between the internal channel and the wellbore annulus, where the valve has a sliding sleeve positioned externally to the tool housing. A first piston surface for opening the valve and a second piston surface for closing the valve are attached to the sleeve and a fluid supply valve directs fluid to the first and second piston surface. An electronic controller operates the fluid control valve to direct the fluid to the first and second control valve.

14 Claims, 11 Drawing Sheets

(56) References Cited

U.S. PATENT DOCUMENTS

| | | | | |
|---|---|---|---|---|
| 7,559,358 | B2 | 7/2009 | DiFoggio et al. | |
| 8,091,633 | B2 | 1/2012 | Al-Khamis | |
| 8,122,954 | B2 | 2/2012 | Estes et al. | |
| 2007/0029197 | A1* | 2/2007 | DiFoggio | E21B 23/00 204/450 |
| 2007/0227731 | A1* | 10/2007 | Contant | E21B 34/06 166/278 |
| 2009/0277629 | A1 | 11/2009 | Mendez et al. | |
| 2013/0081807 | A1 | 4/2013 | Dyer et al. | |
| 2013/0169278 | A1 | 7/2013 | Bittar et al. | |
| 2013/0321165 | A1 | 12/2013 | Johannessen | |
| 2014/0338922 | A1* | 11/2014 | Lopez | E21B 34/066 166/373 |
| 2015/0027706 | A1* | 1/2015 | Symms | E21B 34/066 166/289 |

FOREIGN PATENT DOCUMENTS

| | | | |
|---|---|---|---|
| EP | 1076155 | A1 | 2/2001 |
| WO | 20130161065 | A2 | 5/2013 |

* cited by examiner

EAP ACTUATED VALVE

CROSS-REFERENCE TO RELATED APPLICATIONS

This application is a continuation-in-part of U.S. application Ser. No. 14/328,335, filed Jul. 10, 2014, which claims the benefit of U.S. Provisional Application No. 61/845,104, filed Jul. 11, 2013 and U.S. Provisional Application No. 61/970,775, filed Mar. 26, 2014, all of which are incorporated by reference herein in their entirety.

BACKGROUND OF THE INVENTION

This application generally relates to tools used "downhole" in oil and gas wells. More specifically, certain embodiments of the invention relate to valves, including but not limited to, casing valves used downhole. In many usages, the downhole tool is employed in a "completion" operation, i.e., the process of making a well ready for production, including well stimulation and treatment.

SUMMARY OF SELECTED EMBODIMENTS

One embodiment of the invention is a downhole tool comprising a main tool housing defining an internal channel from an external flow area. A valve allows for selective communication between the internal channel and the external flow areas and a valve actuation mechanism, including an electro-active material, provides at least one of an opening force or a closing force on the valve.

Another embodiment is a downhole completion tool comprising a main tool housing defining an internal channel from an external flow area and a valve allowing selective communication between the internal channel and the external flow areas. A valve actuation mechanism allows opening of the valve without intervention of a tethered activation tool and a propellant containing casing formed on the outside of the tool housing.

Another embodiment is a casing valve comprising a tool housing defining an internal channel from a wellbore annulus. A valve allows selective communication between the internal channel and the wellbore annulus, where the valve comprises a sliding sleeve positioned externally to the tool housing. A first piston surface for opening the valve and a second piston surface for closing the valve are attached to the sleeve and a fluid supply valve directs fluid to the first and second piston surface. An electronic controller operates the fluid control valve to direct the fluid to the first and second control valve.

Still further embodiments are described herein or will be apparent to those skilled in the art based upon the present disclosure.

DETAILED DESCRIPTION OF SELECTED EMBODIMENTS

Figure 1:
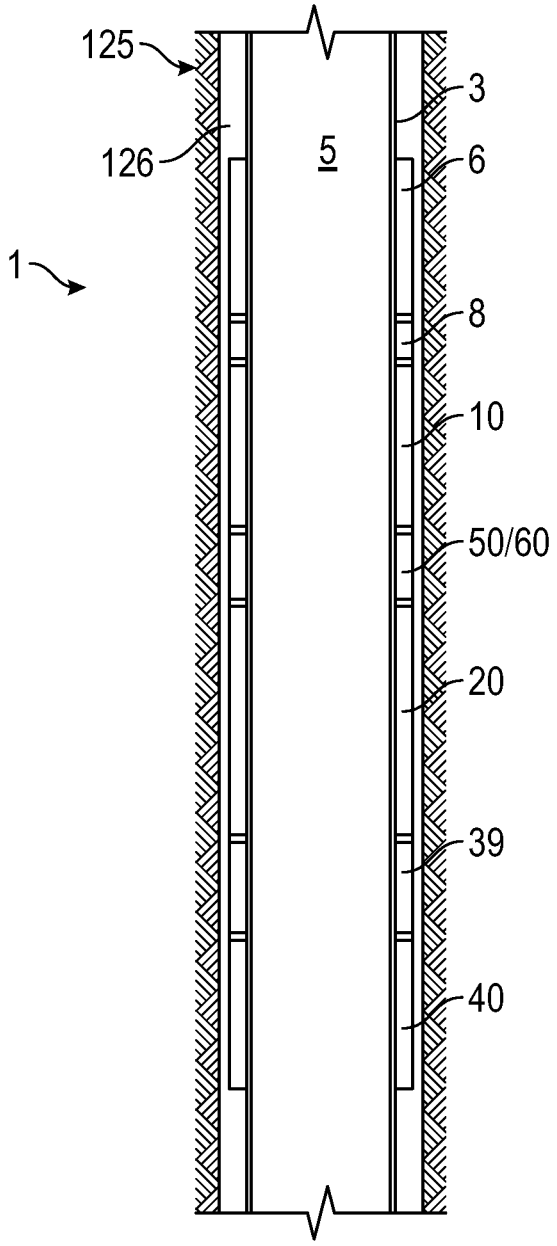
FIG. 1 is a schematic representation of one downhole tool of the present invention.
Figure 3:
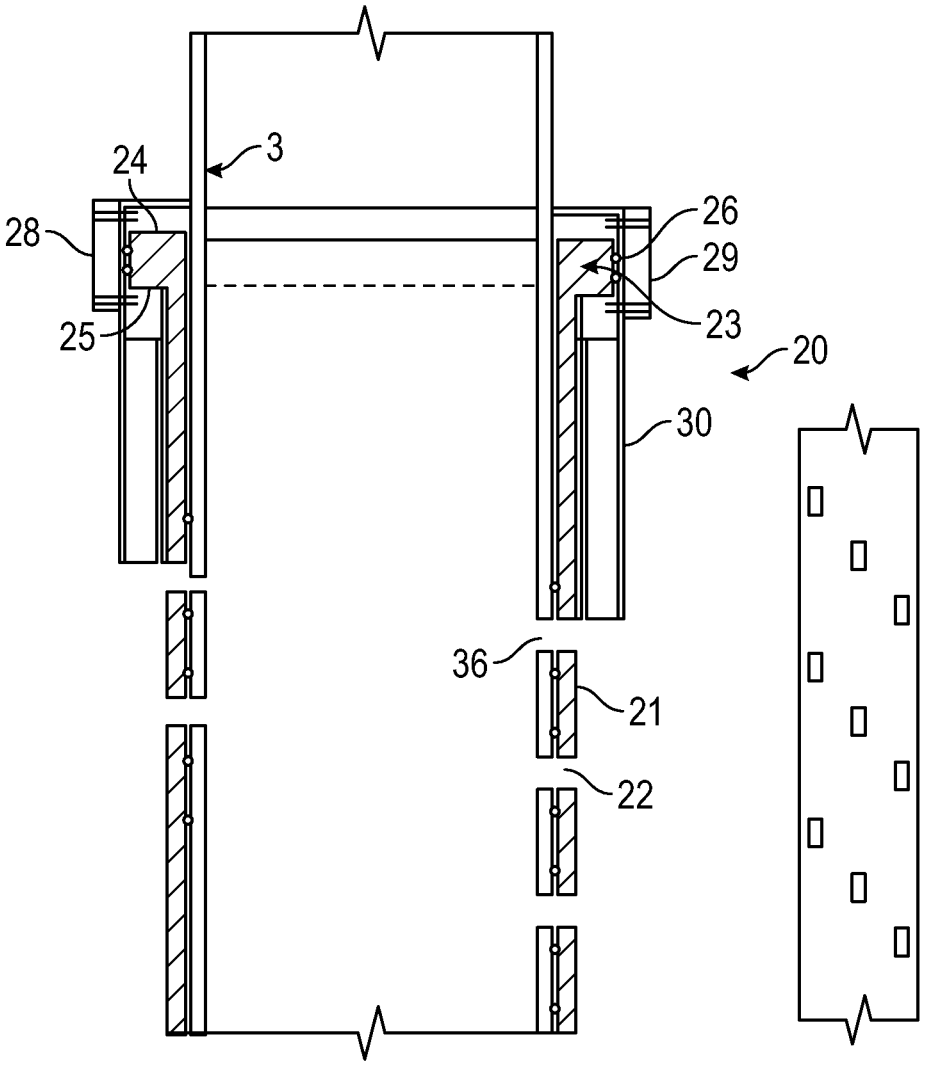
FIG. 3 illustrates one embodiment of a sleeve valve for the downhole tool.

FIG. 1 illustrates one embodiment of the present invention, downhole completion tool 1. In FIG. 1, the downhole tool is shown positioned in a wellbore 125 forming the wellbore annulus 126 between tool 1 and the wall of the wellbore. The annulus 126 as well as the central passage above and below tool 1 may be considered an external flow area to the central passage of tool 1. In many embodiments, the tool 1 is cemented within the wellbore, i.e., cement fills the annulus 126 around the tool. However, there may be other embodiments where the tool is not cemented into the wellbore. The tool 1 generally includes a tool housing 3 having a central passage or internal channel 5. In the example of FIG. 1, the tool housing 3 is formed by one or more sections of conventional well casing. For example, the casing 3 may be conventional production casing, allowing tool 1 to be readily made-up with a string of production casing conventionally used in completion operations. However, housing 3 is not limited to a particular casing type and could be formed from any number of tubular-shaped members. In the illustrated embodiment, a series of components are positioned on housing 3 as suggested schematically in FIG. 1. These components include battery housing 6, gas recharge material section 8, accumulator 10, control circuit housing 50, valve 20, spacer section 39, and propellant charge cartridge or section 40. Often, these components or their housings are circumferential outer bodies surrounding and attached to casing 3. However, there may be alternate embodiments where the components are not circumferential or could be internal to casing 3 (or mounted in the wall of casing 3). All such variations should be interpreted as the components being mounted "on" the casing or housing of the tool. The battery set may be from any conventional or future developed battery type suitable for use in the wellbore environment and capable of powering the functions described herein, with one example being lithium-ion polymer type batteries. In one embodiment illustrated in FIG. 3, valve 20 is an external sliding sleeve "casing valve" formed by the sliding sleeve 21 positioned on the exterior surface of casing 3. Sliding sleeve 21 will include a series of sleeve apertures or openings 22 which may move into and out of alignment with casing apertures 36 in order to open and close, respectively, the valve, thereby allowing selective communication between the internal channel 5 and the wellbore annulus 126. FIG. 3 suggests how seals will isolate sleeve apertures 22 from casing apertures 36 when the apertures are not aligned. Sliding sleeve 21 further includes a sleeve piston 23 having first (upper) piston surface 24 and second (lower) piston surface 25 which are isolated in upper valve housing 30 by seals 26. Generally, the length of upper valve housing need only be sufficient to allow the degree of piston/sleeve movement necessary to align and misalign apertures 22 and 36, for example about 3" to about 5" in many embodiments. It will be apparent from FIG. 3 that application of fluid pressure to upper piston surface 24 will tend to move sleeve apertures 22 into alignment with casing apertures 36, thereby "opening" valve 20. Similarly, application of fluid pressure to lower piston surface 25 will tend to move sleeve apertures 22 out of alignment with casing apertures 36, thereby "closing" valve 20. In the FIG. 3 embodiment, fluid pressure is alternatively directed to pistons surfaces 24 or 25 via the fluid supply valve 28, which may be for example, a solenoid activated valve capable of selectively directing pressurized fluid into the space in valve housing 30 above or below sleeve piston 23. Similarly, a solenoid activated pressure relief valve 29 may act to release pressurized fluid from the space above or below sleeve piston 23, i.e., releasing pressure on the piston face opposite to the piston face on which fluid supply valve 28 is increasing fluid pressure. In many embodiments, the valves 28 and 29 will be operated by a controller such as described below.

Figure 4:
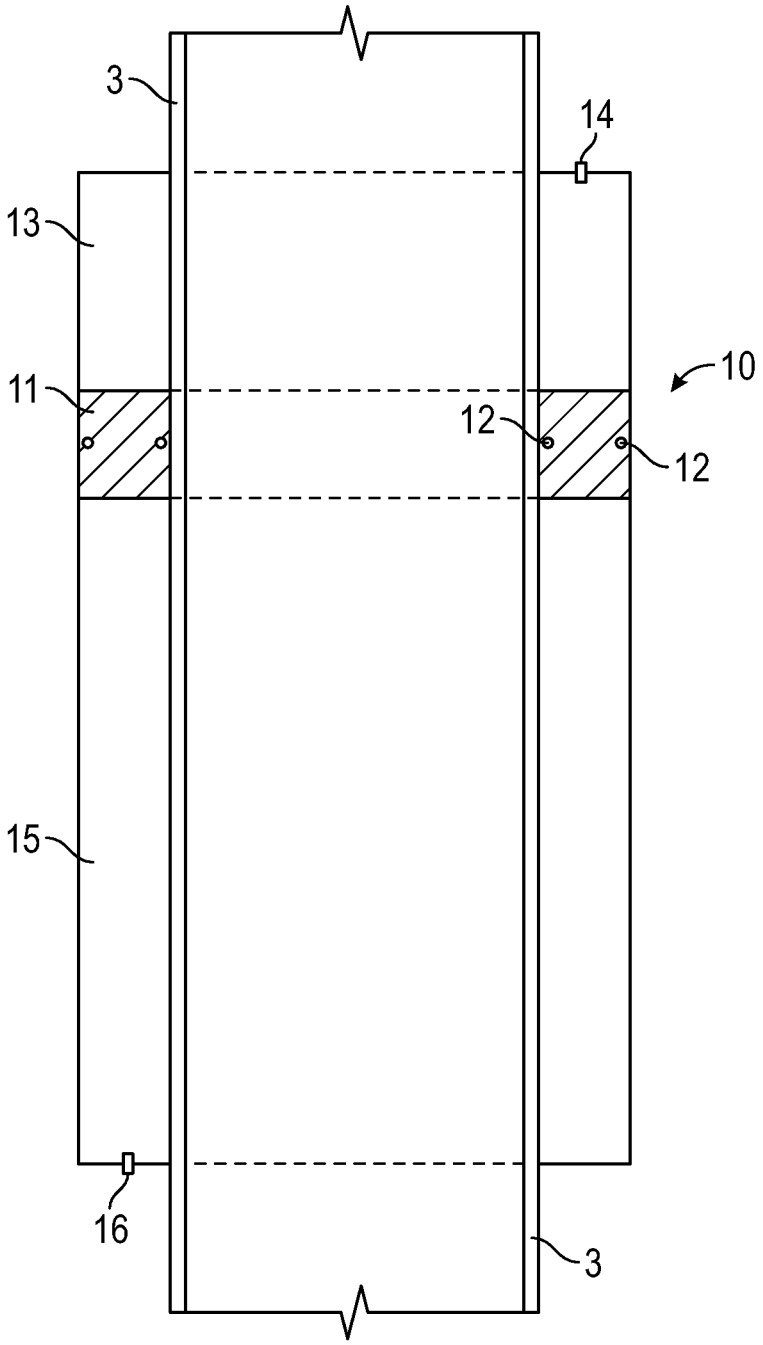
FIG. 4 illustrates one embodiment of an accumulator for the downhole tool.

The embodiment of FIG. 1 also includes an accumulator 10, which is shown in more detail in FIG. 4. This embodiment of accumulator 10 is formed by an annular pressure chamber mounted on casing 30. An internal annular piston 11 having seals 12 divides accumulator 10 between a gas chamber 13 and a hydraulic fluid chamber 15. A hydraulic outlet valve 16 provides for the transfer of hydraulic fluid from the accumulator 10 to sleeve valve 20's fluid supply valve 28. In certain embodiments, outlet valve 16 is a passive check valve allowing hydraulic fluid flow only out of hydraulic fluid chamber 15. However, in other embodiments valve 16 may be an electronically controlled (i.e., by a system controller) valve. It will be understood that gas pressure in chamber 13 acts on piston 11 in order to maintain pressure on hydraulic fluid in chamber 15. In certain embodiments, gas chamber 13 includes an inlet valve 14 (e.g., a passive check valve allowing inflow only) to allow re-supply of gas into chamber 13 to maintain a desired pressure level. Although gas chamber 13 could be re-supplied in any conventional or future developed manner, the FIG. 1 embodiment utilizes a solid to gas phase conversion derived from the igniting of a propellant located in re-charge chamber 8. The re-charge chamber 8 would contain expanding gases from the burning propellant and direct the gases to accumulator inlet valve 14. Re-charge chamber 8 may contain several discrete sections of propellant each may be selectively ignited at different times, thereby allowing re-charge of the gas chamber 13 repeatedly over long periods of time. As an alternative to re-charge chamber 8, other embodiments could have propellant charges positioned directly within the gas chamber of the accumulator. As a further alternative, certain embodiments could have a gas passage extending from the accumulator to the propellant charge section 40, thus allowing gases from the main stimulation propellant to recharge the accumulator. Non-limiting examples of acceptable propellants are the slow burning, lower order class of explosives.

In certain embodiments, hydraulic fluid released from sleeve relief valve 27 is simply discharged into the wellbore environment, i.e., no attempt is made to recover the hydraulic fluid. However, in other embodiments, a fluid path and re-pressurization system could be developed to direct hydraulic fluid back to accumulator 10 after the fluid discharges from relief valve 27.

The FIG. 1 embodiment of tool 1 also illustrates a propellant charge container or cartridge 40 positioned on casing 3. When ignited, the propellant in cartridge 40 will create a pressure wave which acts to stimulate the oil/gas containing formation around tool 1. In many embodiments, it is preferable that cartridge 40 be formed of a material that will maintain its integrity under normal wellbore conditions, but will disintegrate or rapidly degrade once the propellant material is ignited (or alternatively degrade over a designated time period). Non-limiting examples of such materials include carbon fiber composite materials, carbon fiber weave with energetic materials embedded therein, flammable epoxy compounds, or metals that will decompose under the heat and pressure of the ignited propellant (e.g., titanium, magnesium). Any number of propellants could be employed. As used herein, "propellant" means any energetic material, including high and low order explosives and deflagarants (i.e., substances which combust at a subsonic rate). Nonlimiting examples may include PETN, TNT, mixtures thereof, nitrates, perchlorates, mixtures thereof, explosives such as 3,3'-diamino-4,4'-azoxyfurazan (DAAF), and fire resistant, shock resistant insensitive high explosives (IHE) such as triaminotrinitrobenzene (TATB) or various insensitive explosive mixtures, or plastic/polymer-bonded explosives, which are similar to reactive materials. The construction and usage of propellant chamber 40 is described in greater detail in the above referenced U.S. Application Ser. No. 61/970,775, filed Mar. 26, 2014 and U.S. Pat. No. 8,127,832 issued Mar. 6, 2012, which is also incorporated by reference herein. FIG. 1 likewise illustrates a blank section 39 which provides a buffer space between valve 20 and the direct force resulting from the ignition of propellant cartridge 40. Obviously the length of blank section 39 is dependent on the force resulting from igniting the propellant and the robustness of valve 20. In embodiments where propellant cartridge 40 is employed, the force the propellant generates and its distance from valve 20 will be designed to break up and/or pulverize cement surrounding the valve, thereby allowing fluid communication between the valve and the surrounding formation.

Figure 2:
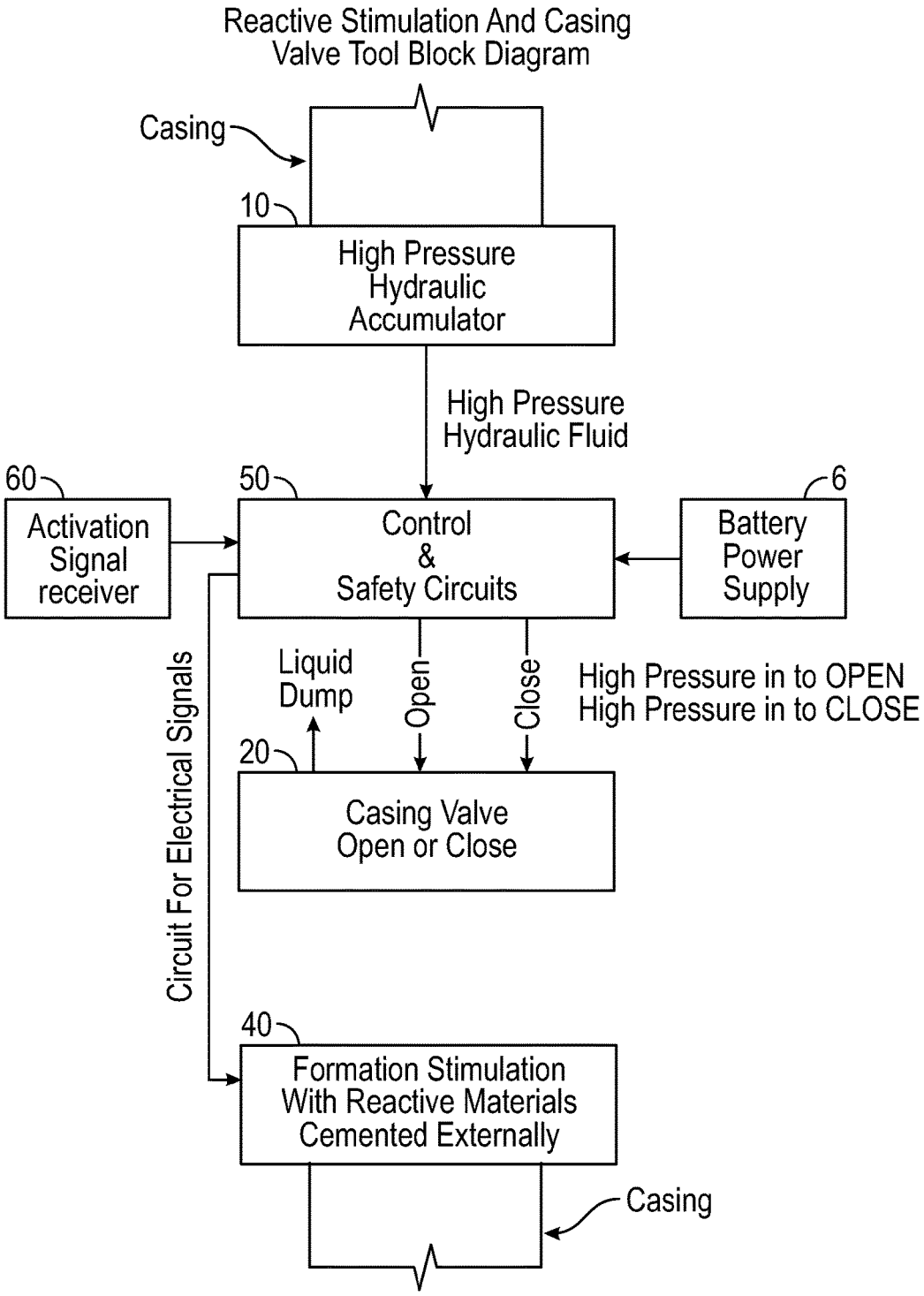
FIG. 2 is a block diagram of one embodiment of a control mechanism for the downhole tool.

In most embodiments of tool 1, the operation of various components described above will be regulated by some type of control system, such as the control (& safety) circuit 50 suggested in FIG. 2. Control circuit 50 (sometimes referred to as "controller" 50) will typically include a conventional microprocessor and the associated electronic components required to operate the tool 1 features as described herein. For example, control circuit 50 will provide instructions to open and close the fluid source valve 28 and the fluid relief valve 27 on sleeve valve 20. Control circuit 50 may also provide instructions initiating the ignition of propellant in gas re-charge chamber 8. Furthermore, control circuit 50 may provide the instructions to ignite (via any conventional ignition system) the propellant in propellant cartridge 40.

FIG. 2 also illustrates an activation signal receiver 60 allowing the control circuit 50 to receive commands to institute the various functions described above. In certain embodiments, the signal receiver may be a pressure transducer which is exposed to pressure in the wellbore environment at the location of tool 1. The pressure transducer may sense a series of low level pressure pulses applied at the surface to fluid in the well annulus or to the internal passage of tool 1. The pressure transducer coverts to pressure pulses to electrical signals which may be interpreted by the controller. The controller in turn activates electro-mechanical devices which are capable of opening various valves or operating other components described herein. One example of a system for converting pressure pulse into the actuation of valves is described in U.S. Pat. No. 4,796,699 issued Jul. 10, 1989 and which is incorporated by reference herein in its entirety. Although the signal receiver 60 described above is a pressure transducer, the system may include any other conventional or future developed signal receiver which is capable of detecting a coded signal, whether that signal is pressure based, electrical, sonic, radio frequency, or some other transmission means.

In the embodiment of FIG. 2, control circuit 50 would interface with a distinct safety circuit which in turn operates an explosive igniter. The initiation signal could originate externally and be received by an activation signal receiver. The received coded signal would be sent to the safety circuit which closes a safety switch and thereby allows an ignition instruction to ignite the propellant. The safety circuit could include a lock-out feature which shuts down the circuit if the coded activation signal is not received in a timely manner. This would prevent a series of inadvertent or environmental pulses over a long sequence from closing the safety switch. In many embodiments, such an activation signal could be of a geophysical nature such as sound waves, but it could be a series of pressure pulses or other detectable signals.

Figure 5:
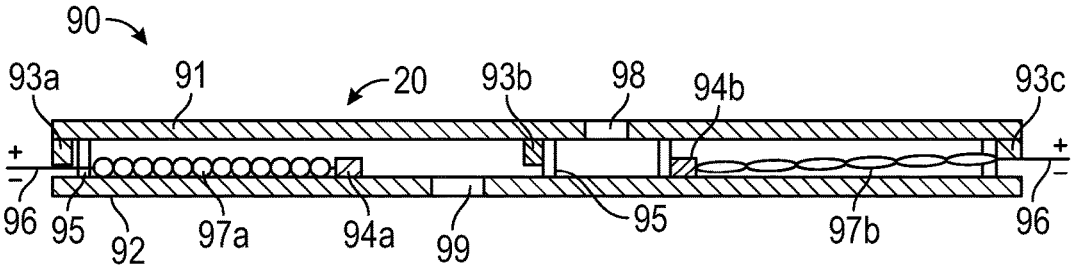
FIG. 5 illustrates an EAP activation mechanism for one embodiment of the downhole tool.

While FIGS. 3 and 4 illustrate one embodiment where the valve 20 is activated by fluid from an accumulator acting on a sleeve piston surface, this is merely one example of the many different valve actuation methods which could be employed in the current invention. FIG. 5 illustrates an alternative valve 20, electro-active polymer (EAP) valve 90. It will be understood that FIG. 5 shows the upper half of a tubular cross-section, with an outer tubular member 91 and an inner tubular member 92. In certain embodiments, inner tubular member 92 may correspond to casing 3. However, other embodiments may be constructed with the outer tubular member 91 correspondence to casing 3 (i.e., the tubular member acting as the sliding sleeve component is internal to the tool). It is only necessary that one tubular member be able to move relative to the other. In the FIG. 5 embodiment, outer tubular member 91 will include a series of apertures 98 and inner tubular member 92 will include a series of apertures 99. Likewise, a series of stop members 93A to 93C are connected to outer tubular member 91, while a series of stop members 94A and 94B are connected to inner tubular member 92. A series of seals 95 are positioned between tubular members 91 and 92, with the seals 95 allowing relative movement between the tubular members, but inhibiting fluid flow around the seals.

It can be seen in FIG. 5 how a first section of EAP material 97A is positioned between outer stop 93A and inner stop 94A. Likewise, a second section of EAP material 97B is positioned between outer stop 93C and inner stop 94B. Electrical leads 96 connect the EAP material sections 97 to an electrical power source such as batteries in the battery casing of FIG. 1. EAP material 97 may be any conventional or future developed EAP material capable of carrying out the valve functions described herein. EAPs may have several configurations, but are generally divided in two principal classes: Dielectric EAPs and Ionic EAPs. As one more specific family of compounds, Poly Vinylidene Fluoride (or PVDF) and its copolymers are widely used ferroelectric polymers. This may include Poly(vinylidene fluoride-trifluoro-ethylene), or P(VDF-TrFE), which is a PVDF polymer having been subject to electron radiation. P(VDF-TrFE) has displayed electrostrictive strain as high as 5% at lower frequency drive fields (150 V/mm).

Other EAPs may include Electrostrictive Graft Elastomers, which are polymers consisting of two components, a flexible macromolecule backbone and a grafted polymer that can be produced in a crystalline form. A typical example of a dielectric EAP is a combination of an electrostrictive-grafted elastomer with a piezoelectric poly(vinylidene fluoride-trifluoro-ethylene) copolymer.

Likewise, Electro-Viscoelastic Elastomers are composites of silicone elastomer and a polar phase. Upon curing, an electric field is applied that orientates the polar phase within the elastomeric matrix. Liquid Crystal Elastomer (LCE) Materials exhibit EAP characteristics by inducing Joule heating. LCEs are composite materials consisting of monodomain nematic liquid crystal elastomers and conductive polymers which are distributed within their network structure.

Alternative activation mechanisms may include Ionic Polymer Gels, including polyacrylonitrile materials which are activated by chemical reaction(s), a change from an acid to an alkaline environment inducing an actuation through the gel becoming dense or swollen. Ionomeric Polymer-Metal Composites (IPMC) can be another alternative and typically can bend in response to an electrical activation as a result of the mobility of cations in the polymer network.

In operation, FIG. 5 suggests the application of electrical power to EAP material section 97B, causing the expansion of this section of EAP material. Acting between stops 94B and 93C, the expanding EAP material tends to move outer aperture 98 to the right of inner aperture 99. With a seal 95 between the two apertures, the valve is closed, i.e., no fluid path exists between the inner passage of the valve and the wellbore annulus. Similarly, it can be envisioned how removing power from EAP material section 97B and applying power to EAP material section 97A will tend to move outer tubular member 91 to the left relative to inner tubular member 92, thereby aligning the apertures 98 and 99 and opening a fluid path to the wellbore annulus.

Figure 6:
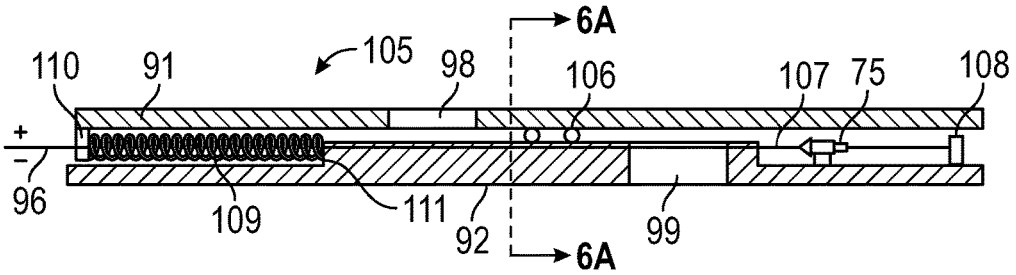
FIG. 6 illustrates an SMA activation mechanism for one embodiment of the downhole tool.
Figure 6A:
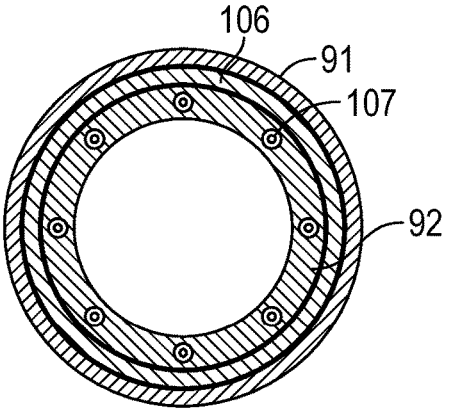

FIG. 6 illustrates another valve embodiment, shaped memory alloy (SMA) activated valve 105. Like the EAP activated valve 90, SMA activated valve 105 includes outer tubular member 91 with valve apertures 98 and inner tubular member 92 with valve apertures 99. Outer tubular member 91 includes the wire anchor 110 and inner tubular member 92 includes wire anchor 108. The SMA wire 107 extends between and is connected to anchors 110 and 108. A closing spring 109 extends between wire anchor 110 and a raised shoulder section 111 formed on inner tubular member 92 (with SMA wire 107 extending through an aperture in shoulder section 111). SMA wire 107 extends through a wire gripper 75 and seals 106 are positioned between tubular members 91 and 92. The section A-A illustrates how a series of SMA wires 107 (and by implication wire grippers 75) are positioned around the circumference of inner tubular member 92.

Any number of SMA materials may be used in constructing wires 107. The two main types of SMAs are copper-aluminium-nickel, and nickel-titanium (NiTi) alloys, but SMAs can also be created by alloying zinc, copper, gold and iron. Although iron-based and copper-based SMAs, such as Fe—Mn—Si, Cu—Zn—Al and Cu—Al—Ni, are commercially available and less expensive than NiTi. NiTi based SMAs are often more preferable for most applications due to their stability, practicability and superior thermo-mechanic performance. SMA actuators are typically actuated electrically, where an electric current results in Joule heating. Deactivation typically occurs by free convective heat transfer to the ambient environment.

Figure 8:
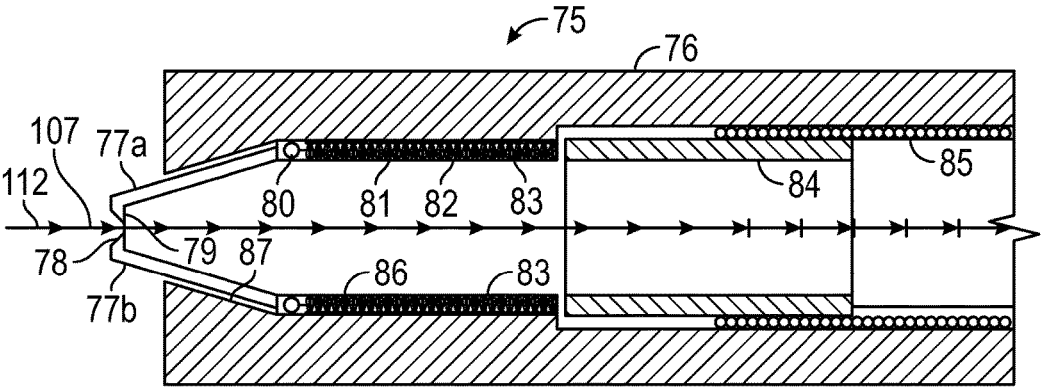
FIG. 8 illustrates a wire gripping mechanism for one embodiment of the downhole tool.

FIG. 8 illustrates one embodiment of a wire gripper 75. Wire gripper 75 generally includes the gripper housing 76 which is shown attached to inner tubular member 92 in the FIG. 5 embodiment. The forward section of gripper housing 76 includes the inclined guide walls 87 which function to urge jaw members 77A and 77B together as explained in more detail below. The jaw members 77A and 77B have at one end the outer inclined surfaces 78 and the inner vertical surfaces 79. The other end of jaw members 77A and 77B will be attached to pin 80 which is capable of traversing longitudinally in the pin slots 81 formed in gripper housing 76. Although the cross-section of FIG. 8 shows two jaw members 77, it will be understood that additional jaw members 77 could be positioned in gripper housing 76 such that the jaws surround SMA wire 107 and form a cone or pyramid shape when in the closed position. As discussed, the pins 80 on jaw members 77 will ride within pin slots 81. It may be envisioned how the movement of jaw members 77 rearward in pin slots 81 and away from guide walls 87 will allow the forward ends of the jaw members to part relative to SMA wire 107. The return springs 82 are positioned in pins slots 81 and operate to urge the jaw members 77 forward against the guide walls 87 (i.e., urge the jaws into their closed, gripping position). Release wires 86 (or alternatively release rods) connect on one end to pins 80, extend through the return springs 82, and connect on the other end to magnetized plunger 84. Magnetize plunger 84 takes on the cross-sectional shape of the internal bore of gripper housing 76 such that plunger 84 may move forward and rearward within the internal bore. Positioned to the rear of, and in a gap between the internal bore wall and plunger 84, are the coil windings 85, which are fixed in position along the surface of the internal bore. It will be understood that magnetized plunger 84 and coil windings 85 form a solenoid type device whereby energizing of coil windings 85 pulls magnetized plunger 84 rearward within the housing internal bore.

With the above described structure, the operation of wire gripper 75 will be apparent. In the FIG. 8 embodiment, the SMA wire 107 includes a series of arrow-head shaped barbs 112 and extends through the internal bore of gripper 75. As the wire 107 pulls through gripper 75 (from left to right), the inclined surface of barbs 112 will encounter the inclined front surface of jaw member 77. Force exerted by barbs 112 on jaw members 75 will compress return spring 82, push jaw members 77 rearward, and allow the jaw members to separate sufficiently to cause the barb 112 to pass between the jaw members. Thereafter, return spring 82 will urge jaw member 77 forward against guide walls 87, causing the jaw members to close again. This mechanism will be repeated as successive barbs 112 are pulled into engagement with jaw members 77. When the wire 107 attempts to move in the opposite direction (from right to left in FIG. 8), the rear vertical surface of barbs 112 encounter the vertical surface 79 of jaw members 77. This direction of force will tend to draw jaw members 77 against guide walls 87 and cause the jaw members to more tightly engage wire 107.

When it is desired to draw jaw members 77 apart in order to release wire 107 (i.e., without actively pulling wire 107 through gripper 75), the coil windings 85 will be energized in order to move plunger 84 rearward. This in turn exerts a rearward force on release wires 86 and jaw pins 80, thereby pulling jaw members 77 rearward as the force of return springs 82 is overcome, and ultimately allowing jaw members 77 to separate. When coil windings 85 cease to be energized, return springs 82 will again urge jaw members 77 forward.

Returning to FIG. 6, it may be envisioned how selectively energizing the various SMA wires 107 in valve 105 will supply the force needed to overcome spring 109 and align the apertures 98 and 99. Viewing section A-A, two (or four) opposing SMA wires 107 are energized in a series of steps. The energized SMA wires 107 will contract, urging the wire anchors 108 and 110 on the inner and outer tubular members closer together. As wire grippers 75 are fixed to inner tubular member 92, all the wire grippers 75 (whether or not associated with energized wires) will move forward on their respective SMA wires 107. When wires 107 cease to be energized, wire grippers 75 engage wire 107 and prevent closing spring 109 from returning the inner and outer tubular members to their initial relative positions. Next, an alternate set of SMA wires 107 are energized, thus further urging relative movement of the inner and outer tubular members and the progressive movement of grippers 75 along the wires 107. It can be seen how this iterative movement of the grippers along wires 107 eventually moves apertures 98 and 99 into alignment and thus opens the valve 105. The controller (see FIG. 2) may be programmed to selectively energize different sets of SMA wires 107 in order to perform this valve opening sequence. To reclose the valve, the solenoid release mechanism in grippers 75 is activated, allowing the grippers to release wires 107 and closing spring 109 to move the apertures 98 and 99 out of alignment.

Figure 7:
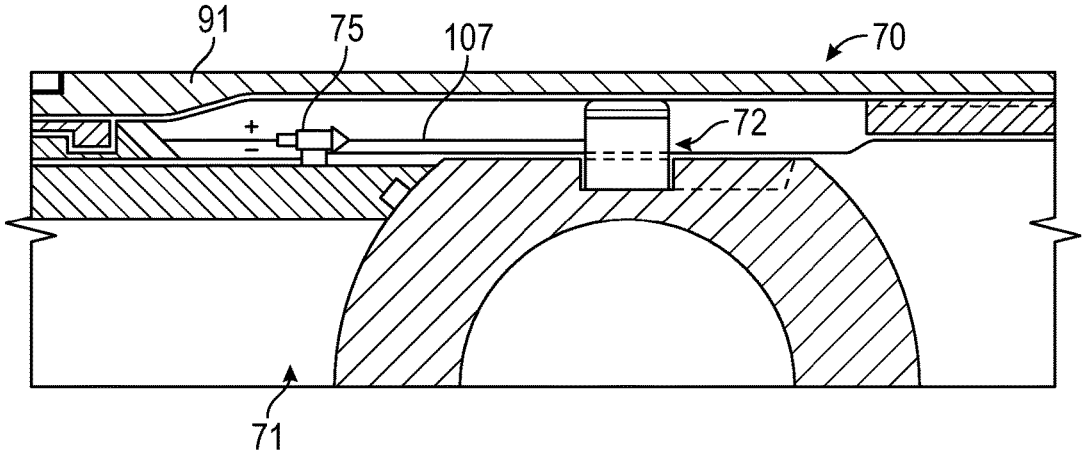
FIG. 7 illustrates a ball valve for one embodiment of the downhole tool.

FIG. 7 suggests a further alternative valve system. FIG. 7 is a half-section view illustrating a ball 71 positioned in ball valve 70. The ball 71 is shown in the closed position, i.e., the center aperture of the ball 71 is unaligned with central passage of the valve's tubular housing. The ball valve is opened by applying torque to the valve stem 72 which rotates the center aperture of ball 71 into alignment with the central passage of the valve housing. In the FIG. 7 embodiment, torque is applied to valve stem 72 by having the SMA wire 107 be affixed to and coiled around valve stem 72, with preferred embodiments having SMA wire 107 making several turns around valve stem 72. Upon energizing SMA wire 107, the wire contracts and applies the torque to stem 72 necessary to rotate the ball 71 to the open position. In certain embodiments, a wire gripper 75 such as described above may be utilized to apply tension to SMA wire 107 in multiply step. However, if the SMA wire 107 constricts sufficiently with one application of electrical current, a wire gripper 75 may not be necessary. Although not shown in the drawings, it will be understood that the ball may be rotated back to the closed position by arranging an opposing section of SMA wire to apply torque in the direction opposite that suggested in FIG. 8.

As used herein, "SMA wire" means any elongated section of SMA material, regardless of thickness or cross-section and could include for example, "rods" of SMA material. Although many embodiments utilize an SMA wire which contracts upon electrification, mechanical arrangements may be implemented using SMA materials which expand or bend upon electrification. "Electro-active material" means any material (solid or fluid) which changes shape or volume when subject to a change in voltage or current, including but not limited to EAP materials and SMA materials. Likewise, the valve actuation mechanism may include any structure used to open or close a valve. For example, in FIG. 3, the valve actuation mechanism includes the piston surfaces and the fluid supply/pressure relief valves. In certain embodiments, a valve actuation mechanism may include an accumulator, in other embodiments it may not. The EAP materials or SMA materials acting against stops or anchors are another example of valve actuation mechanisms.

It will be understood that many embodiments are actuated via a controller activating hydraulic valves, EAP valves, etc. are opening and closing the valve without the intervention of a tethered activation tool; e.g., a tool lowered from the surface on coil tubing or wireline which has a profile for mechanically opening the valve.

Figure 9:
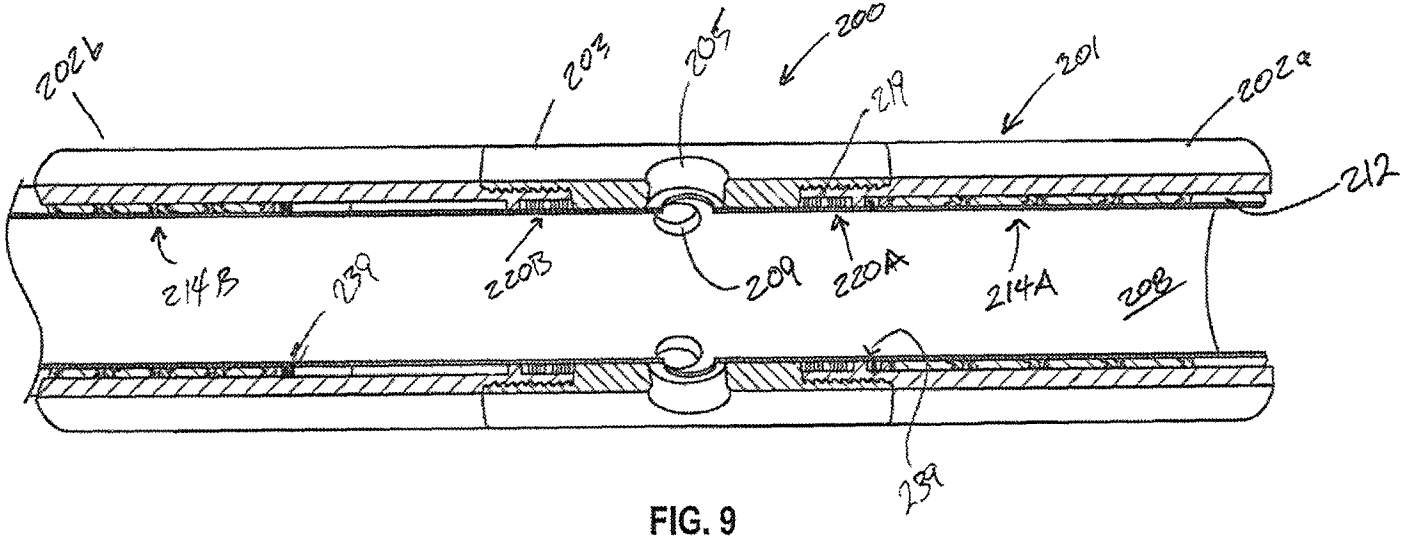
FIG. 9 illustrates an alternate embodiment of an EAP actuated valve assembly.
Figure 10:
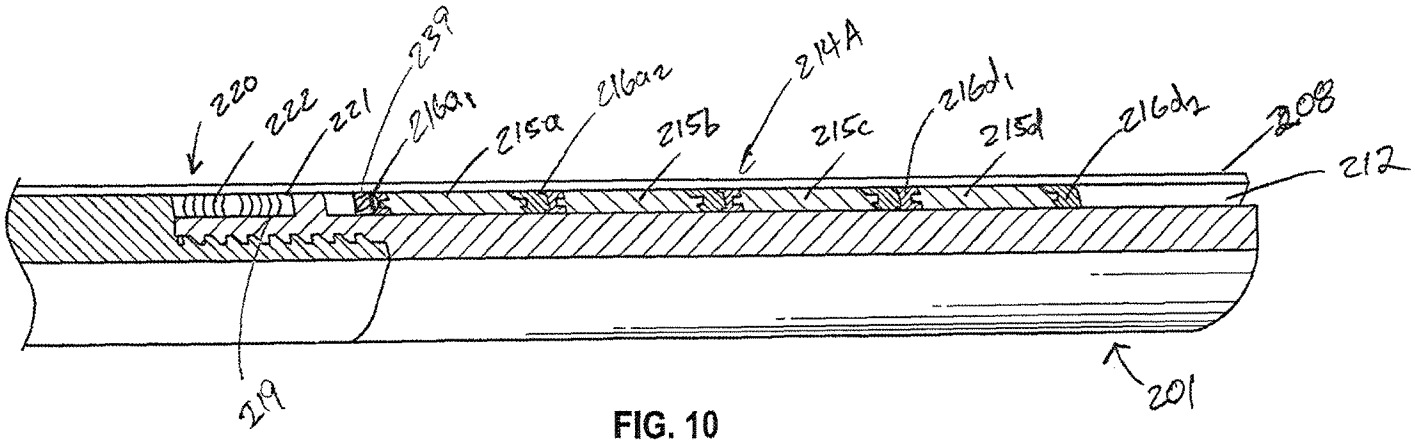
FIG. 10 is an enlarged section view of the FIG. 9 valve assembly.

FIG. 9 illustrates a further embodiment of an electroactive polymer (EAP) actuated valve assembly. Electroactive polymers typically refer to polymers that act as an insulating dielectric between two electrodes and may deflect upon application of a voltage across the electrodes. Examples of EAP materials are disclosed in U.S. Pat. No. 6,891,317, which is incorporated by reference herein. In the particular embodiment of FIGS. 9 and 10, the valve assembly is a sleeve valve 200 generally formed of outer tubular 201 (which forms the main valve housing) and inner tubular (or sleeve) 208. Outer tubular 201 includes the circumferentially spaced outer flow apertures 205 and inner tubular 208 includes circumferentially spaced inner flow aperture 209. As is typical with conventional sleeve valves, the valve is "open" when the inner and out flow apertures 205/209 are aligned and "closed" when the apertures are misaligned with a sealing element separating the inner and outer flow apertures. In FIGS. 9 and 10, these sealing elements are demonstrated by primary seals 220. The illustrated embodiment of outer tubular 201 is formed by end sections 202*a* and 202*b* threaded onto mid-section 203. As readily seen in FIGS. 9 and 10, the wall thickness of mid-section 203 (except for threaded portions) is greater than the wall thickness of end sections 202. Thus, when inner tubular 208 is positioned inside of outer tubular 201, certain annular spaces 212 are formed between inner tubular 208 beneath outer sections 202. The function of annular spaces 212 will be to house EAP actuator assemblies which open and close the valve as described herein. Mid-section 203 also includes the seal pockets 219 which house the primary seals 220.

FIG. 9 shows a right-side EAP actuator assembly 214A and a left-side EAP actuator assembly 214B. The terms "right-side" and "left-side" are used primarily to indicate the actuator assemblies on opposing sides of the flow apertures. For example, "right" and "left" would also indicate "above" and "below" the flow apertures when the valve is positioned vertically in a wellbore. As best seen in the enlarged view of FIG. 10, the illustrated embodiment of EAP actuator assemblies 214 are formed of a series of EAP actuators 215. The structural details of actuators 215 will be explained further below, but the general function of EAP actuators 215 will be to extend axially (i.e., along the length of outer and inner tubulars 201/208), in order to generate a relative axial force between outer and inner tubulars 201/208. The illustrated embodiment further shows the actuators 215 positioned between end caps 216 which function to contain the more flexible EAP material and provide a connection point between the actuators and the inner/outer tubulars. End caps 216 could be formed of a metal (preferably non-magnetic), a hard polymer, a ceramic, or another non-magnetic rigid material. It may be envisioned from FIG. 10 how end cap 216$a_1$ could be fixed to outer tubular 201 (but not inner tubular 208) while end cap 216$d_2$ would be fixed to inner tubular 208 (but not outer tubular 201), while the end caps 216$a_2$ and 216$d_1$, and all other end caps there between, would be free to slide axially within the annular space 212. Thus, when the series of actuators 215 extend axially, end caps 216$a_1$ and 216$d_2$ exert a force in opposite directions, urging inner tubular 208 and outer tubular 201 to move in opposite directions. Using FIG. 9 as an example, if it is assumed that outer tubular 201 is part of a tubular string in a borehole, then outer tubular 201 would be considered fixed as long as the overall string was stationary. In this case, the extending actuators 215 on the right side of FIG. 9 would cause inner tubular 208 to shift to the right, moving inner flow apertures 209 into alignment with outer flow apertures 205. To close the sleeve valve 200, the left side actuators 215 would be energized (with no power applied to the right side actuators), thus urging inner tubular member 208 to the left until inner flow apertures 209 are to the left of primary seal 220B.

Figure 11A:
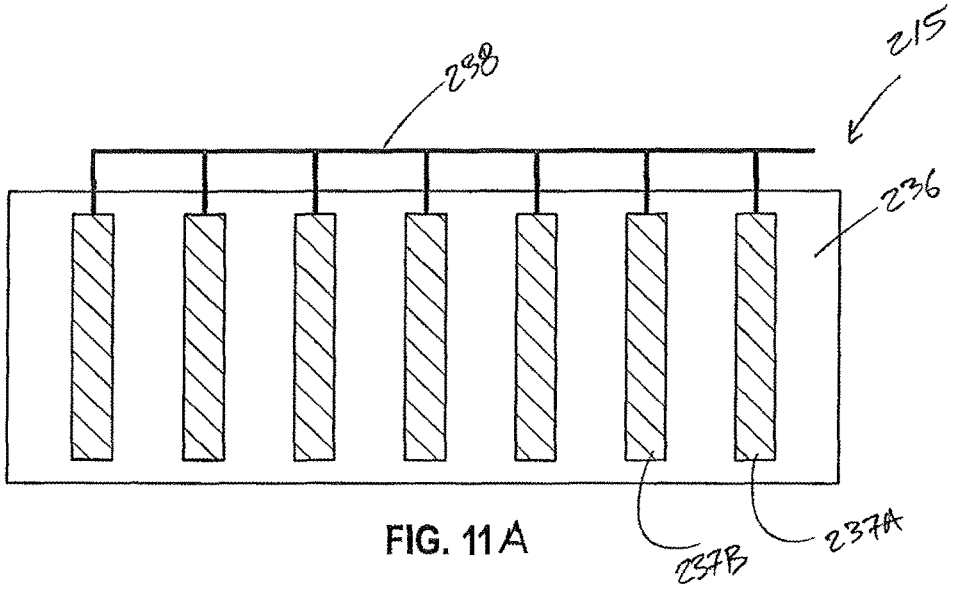
FIG. 11A illustrates the materials forming one axially extending EAP actuator.
Figure 11B:
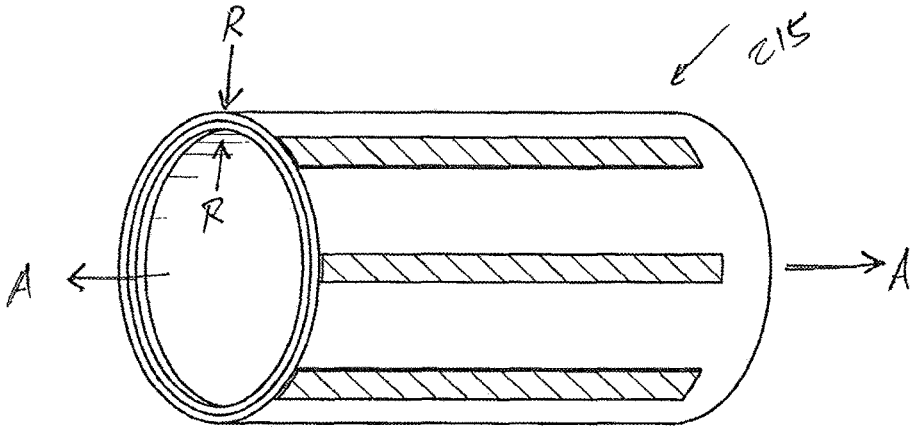
FIG. 11B shows the material of FIG. 11A rolled into an annular configuration.

FIGS. 11A and 11B illustrate one embodiment of an axially extending EAP actuator 215. FIG. 11A shows conceptually the arrangement of materials forming an EAP actuator. An elongated rectangular section or strip of insulating elastomeric polymer material 236 is shown in an open, flat position. The surface visible in the figure has a series of conductive strips 237 adhered thereto. A wire 238 for transmitting voltage is connected to each of the conductive strips 237. The opposite side of polymer material 267 would have a series of corresponding opposite polarity electrodes (not shown) adhered thereto. As an alternative to electrode strips, a continuous layer of conductive material could be applied to each side of polymer material 236 to form a continuous electrode layer. Although not explicitly shown in FIGS. 11A and 11B, it will be understood that conductive leads or wires will typically connect the opposing electrodes to opposing polarities of the power supply. Alternatively, there may be embodiments where one of the electrodes is grounded to the metal housing of the tool, e.g., outer tubular 201. In one particular example, a ceramic end cap could have a metal ring configured to abut outer tubular 201 and the metal ring would in turn be connected to a wire extending to the "ground" electrode of the EAP material. As one nonlimiting example, the polymer material could be formed of a silicone or acrylic elastomer. The electrodes could be a graphite based or carbon black based material applied as a thin layer on the polymer material, e.g., 80% carbon grease and 20% carbon black in a silicone rubber binder, thereby forming a flexible or compliant electrode on the polymer surface. Alternatively, an electrode could be formed by a series of closely spaced and parallel wires extending through the same plane of the elastomer material.

The polymer material 236 with the electrodes applied would then be rolled into an annular shape as suggested in FIG. 11B. Although FIG. 11B shows the electrodes 237 exposed, it will be understood that an insulating layer will exist between the electrodes and the metal surfaces of the annual space in which the electrodes are positioned. The inside diameter of actuator 215 would be formed just large enough to slide over inner tubular 208 and the thickness RR of the rolled actuator would be sufficiently thin to allow the actuator to be positioned in annular space 212 (see FIG. 10). Upon application of a voltage, the opposing electrodes are urged toward one another, thereby compressing the polymer material 236. Because the material is constrained in the radial direction by being wrapped in layers and being positioned between the inner and outer tubulars, the polymer material expands in the axial direction as suggested by arrows AA in FIG. 11B. This expansion generates the axial force imparted by actuators 215. In the FIG. 10 embodiment, the distance over which the actuators 215 apply force is multiplied by positioning in series a plurality of individual actuators 215 in order to form the EAP actuator assemblies 214. As one example, when the EAP material is energized, the actuators will expand about 10% to 12% of their initial length. The length and number of the individual actuators will be sufficient to move the inner tubular a cumulative distance of about 8 to 14 inches.

Figure 12B:
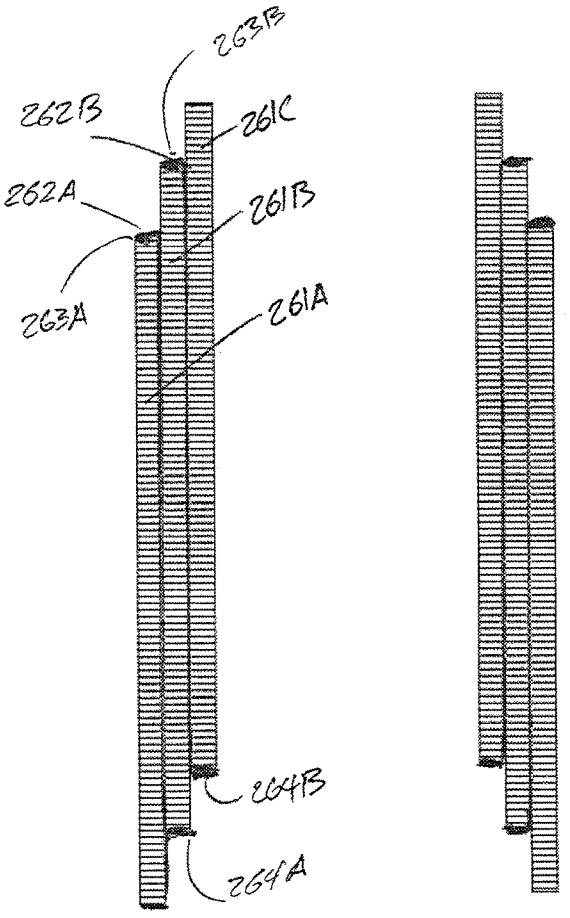
FIGS. 12A and 12B illustrate an alternate axially extending EAP actuator.
Figure 12A:
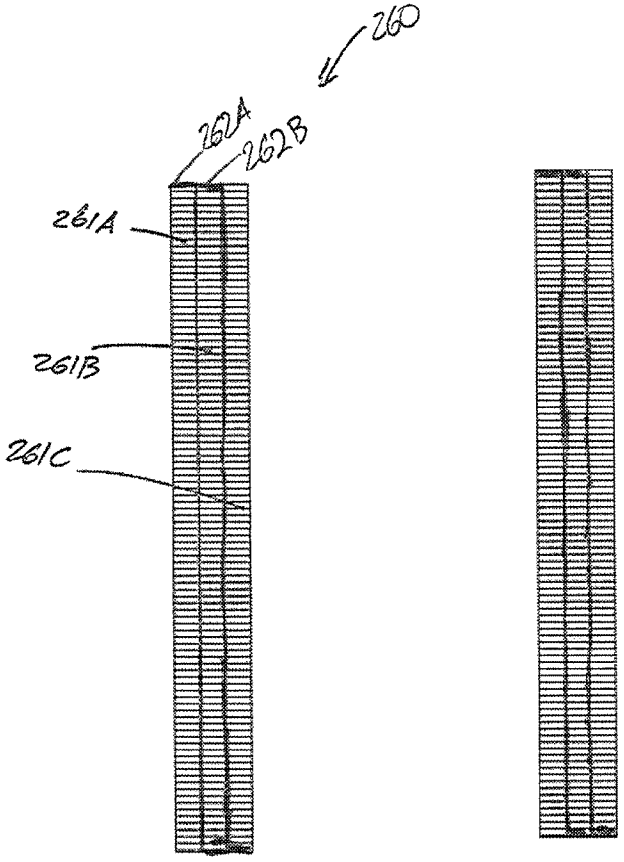

FIGS. 12A and 12B illustrate another embodiment of axially extending EAP actuators. The EAP actuators 260 are formed of a plurality of concentric tubular EAP sections 261A to 261C. Opposing polarity electrode films may be formed on the inner and outer surfaces of these tubular sections. The inside diameter of EAP section 261C will be larger than the outside diameter of inner tubular 208, but EAP actuator 260 will be sufficiently thin to be retained in the annular actuator space 212 (see FIG. 10). As most clearly seen in FIG. 12B, cylindrical support brackets 262 will be positioned between each of the EAP sections 261. The support bracket 262A includes a head portion 263A resting on the "top" surface (from the perspective of FIG. 12) of EAP section 261A and a foot portion 264A supporting the "bottom" surface of EAP section 261B. Similarly, the support bracket 262B includes a head portion 263B resting on the "top" surface of EAP section 261B and a foot portion 264B supporting the "bottom" surface of EAP section 261C. It may be envisioned from FIG. 12B how activation of EAP sections 261 causes section 261A to raise sections 261B and 261C via bracket 262A, and 261B to raise section 261C via bracket 262C. Although not explicitly shown in FIG. 12, an end cap could engage the top of EAP section 261C and the bottom of EAP section 261A. As with the actuator 215 shown in FIG. 11, several EAP actuators 260 could be position in series as an actuator assembly 214, thereby allowing their total length of expansion to be cumulative or additive.

Figure 13:
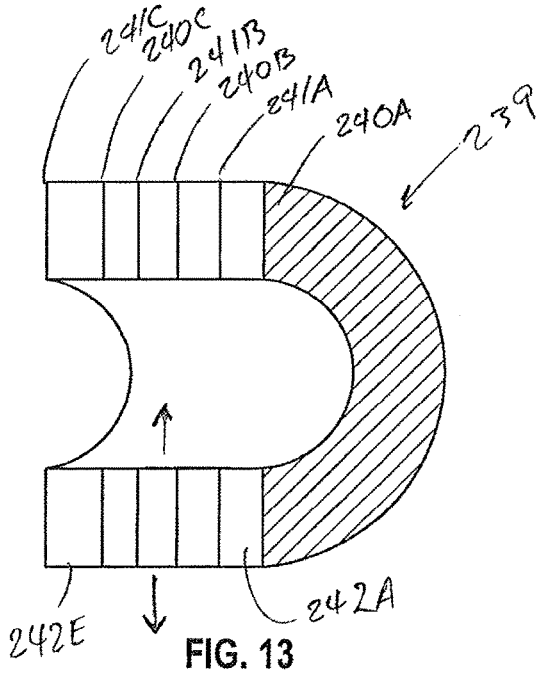
FIG. 13 illustrates one embodiment of an EAP actuated seal.
Figure 14:
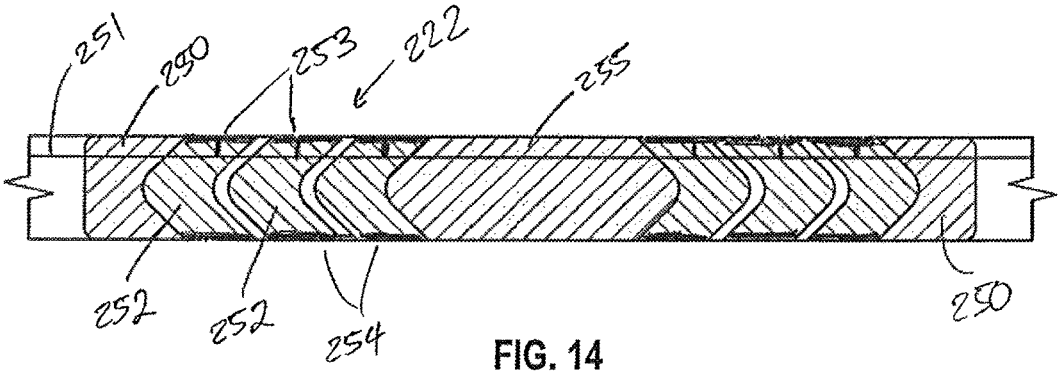
FIG. 14 illustrates one embodiment of an EAP actuated chevron seal.

FIGS. 13 and 14 illustrate two different seal types which may be formed of EAP materials. FIG. 14 is one embodiment of the primary seal 220, which in the illustrated embodiment, is the EAP activated chevron seal 222. As is known in the art, chevron seals may take on an annular shape between two tubulars as suggested in FIGS. 9 and 10. As best seen in FIG. 14, chevron seal 222 generally consists of end adapters 250, center adapter 255, and a series of flexible chevron elements 252 positioned between the adapters. As is typical with chevron seals, pressure acting on either end adapter 250 compresses the chevron elements 252 between the end adapters and center adapter 255, thereby causing radial expansion of chevron elements into sealing engagement with surrounding surfaces. See for example U.S. Pat. No. 5,309,993 which is incorporated by reference herein.

However, in the FIG. 14 embodiment, a first electrode layer 253 has been formed on the outer diameter of chevron sealing elements 252 and a second electrode layer 254 has been formed on the inner diameter of chevron elements 252. A conductor line 251 extends through the seal elements and is in electrical contact with electrode layer 253. Although not explicitly seen in FIG. 14, electrode layers 253 and 254 could be covered with a sufficiently thick layer of insulating material to prevent their contacting the surrounding metal surfaces. Alternatively, the inside surface of seal pocket 219 could be lined with an insulating material.

The FIG. 14 chevron seal 222 behaves in a conventional manner when the seal is being set, i.e., pressure forces the chevron elements together and they expand radially. However, even after pressure is removed, the chevron elements often do not return fully to their unactivated radial dimension. Thus, the chevron elements can partially engage valve components with undesirable frictional force, e.g., the chevron elements can partially engage inner tubular 208 in FIGS. 9 and 10 as the inner tubular is moving to align/misalign the flow apertures 205 and 209. This frictional force is disadvantageous both since it requires additional force to slide inner tubular 208 and since inner tubular 208 sliding past the partially engage chevron elements tends to damage the elements and reduce their sealing effectiveness from that point forward. However, when the chevron elements 252 are effectively formed of an EAP material as shown in FIG. 14, a voltage applied across the electrodes 253/254 will radially compress the chevron elements, eliminating the undesired friction and potential damage to the chevron elements.

FIG. 13 is one embodiment of an annular backup seal (or secondary seal) 239. In the FIG. 10 embodiment, annular backup seal 239 is positioned within annular space 212 "in front" of end cap 216$a_1$, i.e., between end cap 216$a_1$ and outer flow apertures 205. Returning to FIG. 13, backup annular seal 239 may be formed from a series of annular or washer-shaped polymer sections 242. On each side of sections 242 are opposing polarity electrode layers 240 and 241. In the relaxed or unactivated state, the inner and outer diameters of annular backup seal 239 are sized such that the seal provides little or no frictional resistance to the relative movement of inner and outer tubulars 208 and 201 and does not form a seal between the tubulars. For example, in one embodiment, annular backup seal 239 provides less than 5 to 50 lbs. (depending on the application) of frictional resistance to relative tubular movement when in the unactivated state. However, when annular backup seal 239 is activated by applying a sufficient electrical potential is applied across the electrodes, the seal expands radially to form a seal between inner and outer tubulars 208 and 201.

It is expected that in normal operations, chevron seals 222 will perform the primary sealing function between inner and outer tubulars 208 and 201. However, if chevron seals 222 should fail and fluid pressure from flow apertures 205/209 is able to move past the chevron seals toward annular space 212, annular backup seal(s) 239 could be activated to form another sealing barrier between the inner and outer tubulars. Once annular backup seal 239 is activated, it should not be necessary to maintain power to the backup seal. Rather, the pressure differential across the backup seal should maintain the seal in its expanded, sealing state.

Figure 15:
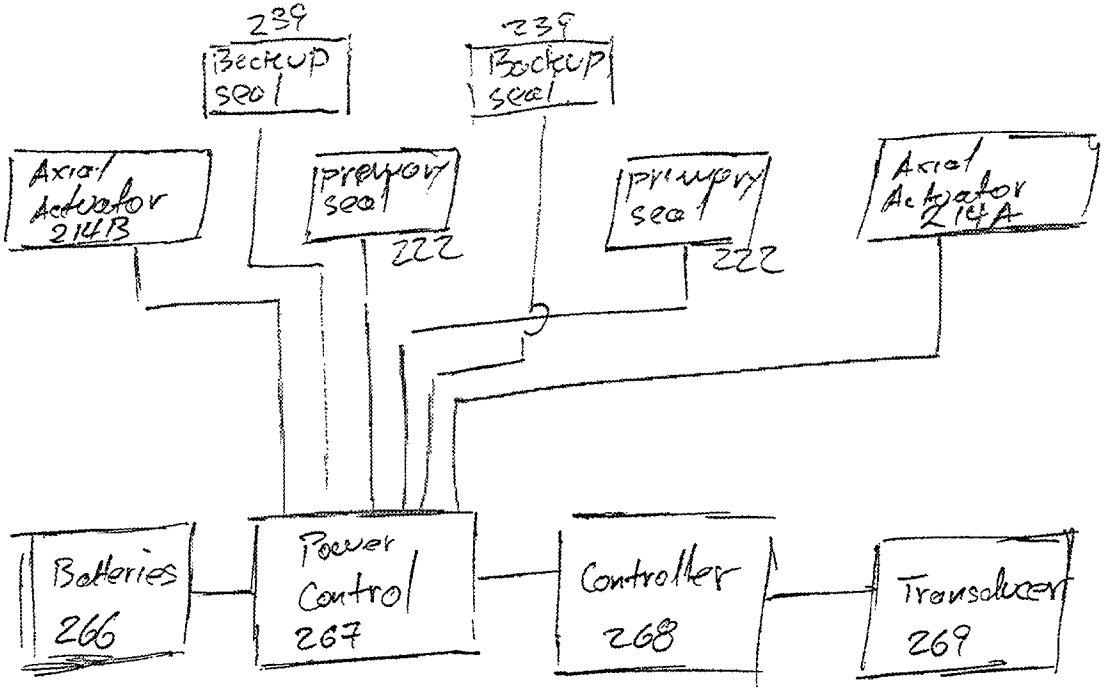
FIG. 15 illustrates one embodiment of control circuitry which could be employed with the valve assembly.

The various EAP elements described herein could be controlled by many different conventional or future developed control systems. FIG. 15 illustrates one example control system. While not explicitly shown in FIG. 9, it may be envisioned how control system components may be install in annular space 212 or a similar annular space located in other tool sections adjacent or near sleeve valve 200. The power control 267 shown in FIG. 15 receives power from batteries 266 and transforms the power to the voltage levels necessary to operate the various EAP elements such as axial actuators 214, primary seals 222, and backup seals 239. Power control 247 will receive commands from controller 268 regarding when and to which EAP elements to direct power. The transducer 269 can receive pressure pulse signals (activation signals) generated at the well surface which controller 268 can interpret as commands to activate different EAP elements. Naturally, pressure transducer 269 could be some other receiver device, such as a receiver for RF signals, optical signals, or a direct connection via a control cable extending to the surface.

Those skilled in the art will recognize many different situations in which the above described EAP elements may be employed in the disclosed sleeve valve. For example, in one embodiment, the control electronics may operate the sleeve valve as a choke valve. In other words, the control electronics may receive a first signal and generate a corresponding command which activates less than all the axially extending EAP actuators 215 in one of the actuator assemblies 215, thereby moving the inner and out flow apertures from a closed, completely misalign configuration, to a only slightly aligned, partially open position. This would allow a first flow rate through the inner and outer flow apertures. A subsequent signal could then cause the control electronics to actuator additional EAP actuators 215, thereby further aligning the flow apertures and allowing a second, greater flow rate. This selection of particular flow rates could be continued as desired until the flow apertures were completely aligned and the valve is in the completely open position providing the maximum flow rate. Likewise, the valve could be gradually closed in the same manner.

In other embodiments, the control electronics are employed to activate the EAP materials in different sequences that will result in more efficient operation of the tool. For example, when moving the valve from the open to closed position (or visa-versa), the control electronics may first activate the EAP chevron elements, causing those elements to radially compress or contract, thereby eliminating or reducing their resistance to the relative movement of the inner and outer tubulars. Only after the chevron elements have contracted would the control electronics then activate the axially extending EAP actuator assembly to cause axial displacement between the inner and outer tubulars. This activation sequence would both reduce the amount of force the axially extending EAP actuators must generate to open/close the sleeve valve, but would also reduce undesirable wear on the chevron seal elements.

Although the embodiments described in the Figures illustrate EAP elements actuating in a single direction, other embodiments could selectively activate EAP elements in multiple directions. For example, the FIG. 13 embodiment could have a first set of electrodes as previously described which deform the EAP material in the radial direction. However, this embodiment could include a second set of opposing electrodes on the inner diameter surface 243 and outer diameter surface 244. This second set of electrodes would tend to expand the EAP material in an axial direction. Thus, a single section of EAP material could act both as an axially extending actuator when the control electronics energize the second set of electrodes and a radially expanding seal when the control electronics energize the first set of electrodes. In the case where multiple axially extending EAP actuators form an axially extending actuator assembly, only one or two of the individual EAP actuators need also to have a second set of electrodes to form radially extending EAP seals.

Although many embodiments are shown as having a local power source such as batteries, other embodiments could utilize power carried by conductors running from the surface. Likewise, certain embodiments disclose the controller receiving coded signals (generally wireless) via a signal receiver. However, the controller could also carry out instructions based on date/time or sensing certain wellbore conditions, e.g., pressure, temperature, pH, etc. Additionally, the controller could receive signals through a communication wire/cable running to the surface.

Although the above described figures disclose certain specific embodiments of the present invention, all obvious variations and modifications of the illustrated embodiments should be considered as following within the scope of the present invention.

The invention claimed is:

1. A sleeve valve comprising:

a. an outer tubular with at least one outer flow aperture;

b. an inner tubular with at least one inner flow aperture;

c. an annular space formed between the inner and outer tubulars;

d. a predominantly axially extending right-side EAP actuator assembly positioned on a right side of the inner and outer flow apertures within the annular space;

e. a predominantly axially extending left-side EAP actuator assembly position on a left side of the inner and out flow apertures within the annular space;

f. wherein the right-side and left-side EAP actuator assemblies (i) include a plurality of EAP actuators, and (ii) are configured to apply an axial opposing force between the inner and outer tubulars;

g. wherein the EAP actuators have end caps and an end cap of a right-side EAP actuator is fixed to the outer tubular and another end cap of a right-side EAP actuator is fixed to the inner tubular member, and h. control electronics configured to selectively energize the EAP actuator assemblies.

2. The sleeve valve according to claim 1, wherein the right-side EAP actuator assembly has at least three actuators with end caps, and wherein (i) the end cap most proximate to the flow apertures is fixed to one of the inner or outer tubular, (ii) the end cap most distal from the flow apertures is fixed to the other of the inner or outer tubular, and (iii) the end caps between the most proximal and most distal are not fixed to either the inner or outer tubular.

3. The sleeve valve according to claim 1, wherein the EAP actuator assemblies extend circumferentially around the inner tubular.

4. The sleeve valve according to claim 1, wherein energizing of one of the left-side or right-side EAP actuator assemblies aligns the inner and out flow passages and energizing the other of the left-side or right-side EAP actuator assemblies misaligns the inner and outer flow passages.

5. The sleeve valve according to claim 1, wherein the control electronics further includes a power source.

6. The sleeve valve according to claim 5, wherein the control electronics include a receiver for receiving activation signals.

7. The sleeve valve according to claim 6, wherein the receiver is configured to detect pressure pulses induced in fluid within a wellbore containing the sleeve valve.

8. A sleeve valve comprising:

a. an outer tubular with at least one outer flow aperture;

b. an inner tubular with at least one inner flow aperture;

c. an annular space formed between the inner and outer tubulars;

d. a predominantly axially extending right-side EAP actuator assembly positioned on a right side of the inner and outer flow apertures within the annular space;

e. a predominantly axially extending left-side EAP actuator assembly position on a left side of the inner and out flow apertures within the annular space;

f. wherein the right-side and left-side EAP actuator assemblies are configured to apply an axial opposing force between the inner and outer tubulars;

g. wherein primary seals are positioned inwardly of the EAP actuator assemblies and on either side of the inner and outer flow passages when the passages are in an aligned position;

h. wherein the primary seals include seal elements formed of an EAP material configured to radially compress upon activation; and i. control electronics configured to (i) selectively energize the EAP actuator assemblies, and (ii) selectively energize the EAP material of the primary seals.

9. The sleeve valve according to claim 8, wherein one of the primary seals is positioned between the inner and outer flow passages when flow passages are in a misaligned position.

10. The sleeve valve according to claim 8, wherein the primary seals are bi-directional chevron seals.

11. The sleeve valve according to claim 10, further comprising a control electronics and a power source, wherein the control electronics energize the chevron seals prior to energizing one of the EAP actuator assemblies.

12. The sleeve valve according to claim 8, further comprising secondary seals including a predominantly radially expanding EAP actuator, the secondary seals positioned between the primary seals and an outer end cap on each of the left-side and right-side EAP actuator assemblies.

13. The sleeve valve according to claim 12, wherein the secondary seals are connected to the left-side and right-side EAP actuator assemblies and move with the left-side and right-side actuator assemblies.

14. The sleeve valve according to claim 12, wherein the secondary seals further comprise a plurality of annular EAP seal elements.

* * * * *